US011440774B2

(12) United States Patent
Castro Inzunza et al.

(10) Patent No.: US 11,440,774 B2
(45) Date of Patent: Sep. 13, 2022

(54) ELEVATOR ROPING SWAY DAMPER ASSEMBLY

(71) Applicant: OTIS ELEVATOR COMPANY, Farmington, CT (US)

(72) Inventors: Cuauhtemoc Castro Inzunza, Florence, SC (US); Michael J. Tracey, Cromwell, CT (US); Patricia Derwinski, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 157 days.

(21) Appl. No.: 16/870,961

(22) Filed: May 9, 2020

(65) Prior Publication Data

US 2021/0347607 A1 Nov. 11, 2021

(51) Int. Cl.

| | |
|---|---|
| ***B66B 7/04*** | (2006.01) |
| ***B66B 7/06*** | (2006.01) |
| ***B66B 7/12*** | (2006.01) |

(52) U.S. Cl.

CPC ..... *B66B 7/046* (2013.01); *B66B 7/068* (2013.01); *B66B 7/1246* (2013.01)

(58) Field of Classification Search

CPC ..... B66B 7/046; B66B 7/068; B66B 7/1246; B66B 7/048; B66B 7/06; B66B 11/026; B66B 5/021; B66B 5/022

See application file for complete search history.

(56) References Cited

U.S. PATENT DOCUMENTS

| | | | | |
|---|---|---|---|---|
| 4,079,816 A * | 3/1978 | Ohta | B66B 7/06 174/42 |
| 4,117,908 A * | 10/1978 | Nara | B66B 7/06 187/254 |
| 4,460,065 A * | 7/1984 | Saxer | B66B 7/06 187/278 |
| 5,025,893 A * | 6/1991 | Saito | B66B 7/06 187/266 |
| 5,103,937 A * | 4/1992 | Robertson | B66B 7/06 174/42 |

(Continued)

FOREIGN PATENT DOCUMENTS

| | | |
|---|---|---|
| CN | 1642838 A | 7/2005 |
| CN | 101058382 A | 10/2007 |

(Continued)

OTHER PUBLICATIONS

JP-06156933-A—Machine Translation (Year: 1994).*

(Continued)

*Primary Examiner* — Michael A Riegelman

(74) *Attorney, Agent, or Firm* — Carlson, Gaskey & Olds, P.C.

(57) ABSTRACT

An illustrative example embodiment of an elevator rope sway damping assembly includes a plurality of sway dampers having a width and a length. An actuator device selectively causes movement of the sway dampers in a direction transverse to the length between a first position where the sway dampers are spaced apart by a first distance and a second, sway-damping position where the sway dampers are spaced apart by a second, shorter distance. The actuator device provides an indication when the sway dampers are in the first position.

19 Claims, 2 Drawing Sheets

(56) References Cited

U.S. PATENT DOCUMENTS

| | | | | |
|---|---|---|---|---|
| 5,509,503 | A * | 4/1996 | Salmon | B66B 11/08 187/266 |
| 5,861,084 | A * | 1/1999 | Barker | B66B 7/10 187/264 |
| 5,947,232 | A * | 9/1999 | Traktovenko | B66B 7/06 187/414 |
| 6,488,125 | B1 * | 12/2002 | Otsuka | B66B 7/068 187/264 |
| 7,793,763 | B2 * | 9/2010 | Zhu | B66B 7/06 187/411 |
| 9,067,761 | B2 * | 6/2015 | Ropponen | B66B 7/06 |
| 9,359,172 | B2 * | 6/2016 | Mangini | B66B 5/021 |
| 10,099,895 | B2 * | 10/2018 | Miseur | B66B 7/06 |
| 10,308,479 | B2 | 6/2019 | Zerelles et al. | |
| 10,669,124 | B2 * | 6/2020 | Copeland | B66B 7/06 |
| 10,669,125 | B2 * | 6/2020 | Miyajima | B66B 7/023 |
| 2005/0133312 | A1 * | 6/2005 | Kaczmarek | B66B 7/068 187/266 |
| 2010/0065381 | A1 * | 3/2010 | Roberts | B66B 7/06 187/401 |
| 2013/0048438 | A1 * | 2/2013 | Mangini | B66B 7/06 187/414 |
| 2013/0133983 | A1 * | 5/2013 | Mangini | B66B 5/021 187/277 |
| 2014/0224590 | A1 * | 8/2014 | Puranen | B66B 5/02 187/247 |
| 2015/0166304 | A1 * | 6/2015 | Roberts | B66B 1/28 187/278 |
| 2016/0017708 | A1 * | 1/2016 | Cao | E21D 7/02 187/408 |
| 2016/0236905 | A1 * | 8/2016 | Zerelles | B66B 7/06 |
| 2018/0290862 | A1 * | 10/2018 | Copeland | B66B 7/06 |
| 2018/0327226 | A1 * | 11/2018 | Miyajima | B66B 7/023 |
| 2020/0283268 | A1 * | 9/2020 | Copeland | B66B 7/06 |
| 2021/0347607 | A1 * | 11/2021 | Castro Inzunza | B66B 7/068 |

FOREIGN PATENT DOCUMENTS

| | | | | |
|---|---|---|---|---|
| CN | 101343010 | A | | 1/2009 |
| CN | 102811936 | A | | 12/2012 |
| CN | 103935865 | A | | 7/2014 |
| CN | 203845623 | U | | 9/2014 |
| CN | 104276481 | A | | 1/2015 |
| CN | 104310161 | A | | 1/2015 |
| JP | 06156933 | A | * | 6/1994 |
| JP | 2766946 | B2 | | 6/1998 |
| JP | 2001316058 | A | | 11/2001 |
| JP | 2004059211 | A | | 2/2004 |
| JP | 2005170655 | A | | 6/2005 |
| JP | 2007119131 | A | | 5/2007 |
| JP | 4208425 | B2 | | 1/2009 |
| JP | 4776281 | B2 | | 9/2011 |
| JP | 4910573 | B2 | | 4/2012 |
| JP | 2014162587 | A | | 9/2014 |
| JP | 2014227291 | A | | 12/2014 |
| JP | 2015134654 | A | | 7/2015 |
| KR | 20100008668 | U | | 9/2010 |
| WO | 2006038397 | A1 | | 4/2006 |
| WO | 2009116985 | A1 | | 9/2009 |
| WO | 2015013684 | A2 | | 1/2015 |
| WO | 2016027298 | A1 | | 2/2016 |

OTHER PUBLICATIONS

JP2766946—Machine Translation (Year: 1991).*

Extended European Search Report for Application No. EP 18 16 6125 dated Oct. 9, 2018.

First Office Action for CN Application No. 201810314032.7 dated Aug. 14, 2019.

* cited by examiner

ELEVATOR ROPING SWAY DAMPER ASSEMBLY

BACKGROUND

Elevator systems are useful for carrying passengers and items between different levels of a building. Elevator systems in high rise buildings typically are traction-based and include roping that suspends the elevator car and a counterweight. A machine causes movement of a traction sheave that, in turn, causes movement of the roping for moving the elevator car as desired.

Elevator roping arrangements may experience sway or drift when the building in which the elevator system is installed sways or drifts. A variety of approaches have been proposed to address elevator roping sway including using dampers in the hoistway and controlling elevator car movement to mitigate sway. It is useful to avoid roping sway to maintain a desired level or quality of ride and to avoid damaging elevator system components.

SUMMARY

An illustrative example embodiment of an elevator roping sway damping assembly includes a plurality of sway dampers having a width and a length. An actuator device selectively causes movement of the sway dampers in a direction transverse to the length between a first position where the sway dampers are spaced apart by a first distance and a second, sway-damping position where the sway dampers are spaced apart by a second, shorter distance. The actuator device provides an indication when the sway dampers are in the first position.

In an example embodiment having at least one feature of the assembly of the previous paragraph, the sway dampers comprise elongate cylindrical bumpers and the length is greater than the width.

In an example embodiment having at least one feature of the assembly of any of the previous paragraphs, the sway dampers comprise rollers supported to rotate about an axis along the length.

In an example embodiment having at least one feature of the assembly of any of the previous paragraphs, the actuator device causes linear movement of the sway dampers between the first and second positions.

In an example embodiment having at least one feature of the assembly of any of the previous paragraphs, the actuator device includes a plurality of sheaves and a band that wraps at least partially around the sheaves. At least one of the sheaves rotates to cause movement of the band. The sway dampers are supported for movement with the band between the first and second positions in response to rotation of the at least one of the sheaves.

In an example embodiment having at least one feature of the assembly of any of the previous paragraphs, the band has a length that is oriented perpendicular to the length of the sway dampers.

In an example embodiment having at least one feature of the assembly of any of the previous paragraphs, the actuator device includes a plurality of mounting brackets secured to the band and the sway dampers are supported on the mounting brackets.

In an example embodiment having at least one feature of the assembly of any of the previous paragraphs, the at least one of sheaves rotates in a first direction to move the sway dampers toward the first position and in a second, opposite direction to move the sway dampers toward the second position.

In an example embodiment having at least one feature of the assembly of any of the previous paragraphs, the biasing mechanism includes a weight associated with at least one of the sheaves and gravity urges the weight to cause rotation of the at least one of the sheaves in the first direction.

In an example embodiment having at least one feature of the assembly of any of the previous paragraphs, the actuator device includes a biasing mechanism that biases the sway dampers into the first position.

In an example embodiment having at least one feature of the assembly of any of the previous paragraphs, the actuator device includes at least one detector that detects when the sway dampers are in the first position and provides an output indicating that the sway dampers are in the first position.

An illustrative example embodiment of an elevator system includes the assembly of any of the previous paragraphs, an elevator car situated in a hoistway, a plurality of suspension members supporting the elevator car, and a controller that controls movement of the elevator car, the controller using the indication from the actuator device for controlling movement of the elevator car in a portion of the hoistway that includes the sway dampers.

In an example embodiment having at least one feature of the elevator system of the previous paragraph, the controller prevents the elevator car from moving into the portion of the hoistway when the sway dampers are not in the first position.

In an example embodiment having at least one feature of the elevator system of any of the previous paragraphs, the controller adjusts a motion profile of the elevator car for moving through the portion of the hoistway when the sway dampers are in the second position.

In an example embodiment having at least one feature of the elevator system of any of the previous paragraphs, the elevator car includes an external surface oriented at an oblique angle relative to a direction of movement of the elevator car. The external surface is configured to engage the sway dampers and move the sway dampers toward the first position as the elevator car moves into the portion of the hoistway that includes the sway dampers.

In an example embodiment having at least one feature of the elevator system of any of the previous paragraphs, the plurality of sway dampers includes a plurality of sets of sway dampers. Each set of sway dampers is in a different vertical location along the hoistway. The controller controls the sets of sway dampers to selectively move the sway dampers between the first and second positions based, in part, on a location of the elevator car in the hoistway.

In an example embodiment having at least one feature of the elevator system of any of the previous paragraphs, the length of the sway dampers is transverse to a height of the hoistway. The sway dampers extend from one side of the hoistway toward a center of the hoistway. The actuator device moves the sway dampers in a direction parallel to the side of the hoistway when moving the sway dampers between the first and second positions.

In an example embodiment having at least one feature of the elevator system of any of the previous paragraphs, the length of the sway dampers are horizontal and the actuator device moves the sway dampers linearly and horizontally between the first and second positions.

In an example embodiment having at least one feature of the elevator system of any of the previous paragraphs, the elevator car has a depth, a width and a height. The first distance between the sway dampers in the first position is greater than the depth and greater than the width.

In an example embodiment having at least one feature of the elevator system of any of the previous paragraphs, the plurality of suspension members are situated near a center of the hoistway. A first one of the sway dampers and a second one of the sway dampers are situated on opposite sides of the suspension members to prevent sway in a first direction when the first and second sway dampers are in the second position. A third one of the sway dampers and a fourth one of the sway dampers are situated on opposite sides of the suspension members to prevent sway in a second direction when the third and fourth sway dampers are in the second position. The second direction is perpendicular to the first direction.

The various features and advantages of at least one disclosed example embodiment will become apparent to those skilled in the art from the following detailed description. The drawings that accompany the detailed description can be briefly described as follows.

DETAILED DESCRIPTION

Figure 1:
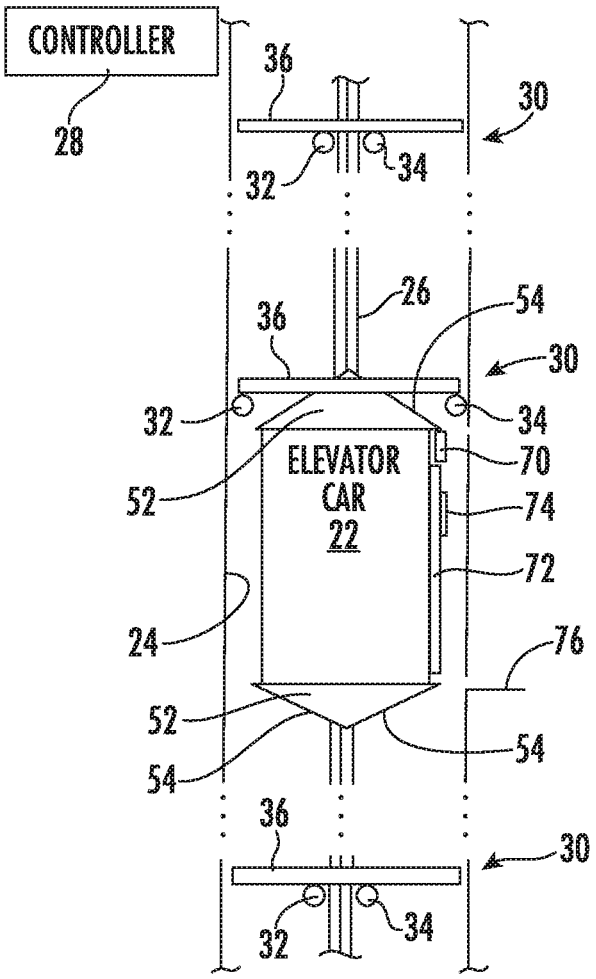
FIG. 1 schematically illustrates selected portions of an elevator system including a roping sway damping assembly designed according to an embodiment of this disclosure.

FIG. 1 schematically shows selected portions of an elevator system 20. An elevator car 22 is situated for movement along a vertical path in a hoistway 24. The elevator car 22 is suspended by roping 26, which includes a plurality of elongate traction and suspension members such as ropes or belts. A controller 28 controls the position and movement of the elevator car 22 by controlling operation of a machine (not illustrated) that selectively causes movement of the roping 26.

The elevator system 20 includes a sway damping assembly 30 to reduce or prevent sway or drift of the roping 26 within the hoistway 24. As shown in FIG. 1, the sway damping assembly 30 includes a plurality of sway dampers 32, 34, 36. In the illustrated example embodiment, several sets of sway dampers 32, 34, 36 are situated at different heights or locations along the hoistway 24. As can be appreciated from FIG. 3, each set of sway dampers includes another sway damper 38 that is not visible in the view of FIG. 1.

The sway dampers 32-38 are moveable between different positions. A first position where the sway dampers 32 and 34 of each set are spaced apart by a first distance and the sway dampers 36 and 38 of each set are spaced apart by a first distance is used to allow the elevator car 22 to pass through a portion of the hoistway 24 including that set of sway dampers 32-38. In FIG. 1, the set of sway dampers 32-36 shown closest to the elevator car 22 are in the first position. The distance between the corresponding sway dampers is larger than a width and a depth of the elevator car 22, respectively.

A second, sway-damping position places the sway dampers 32-38 much closer to the roping 26 where the sway dampers can reduce or minimize any sway or drift of the roping 26. In the second position the sway dampers 32 and 34 are spaced apart by a second distance that is smaller than the first distance and the sway dampers 36 and 38 are spaced apart by a second distance. The sets of sway dampers 32-36 shown near the top and bottom of the illustration in FIG. 1 are shown in the second, sway-damping position.

Figure 2:
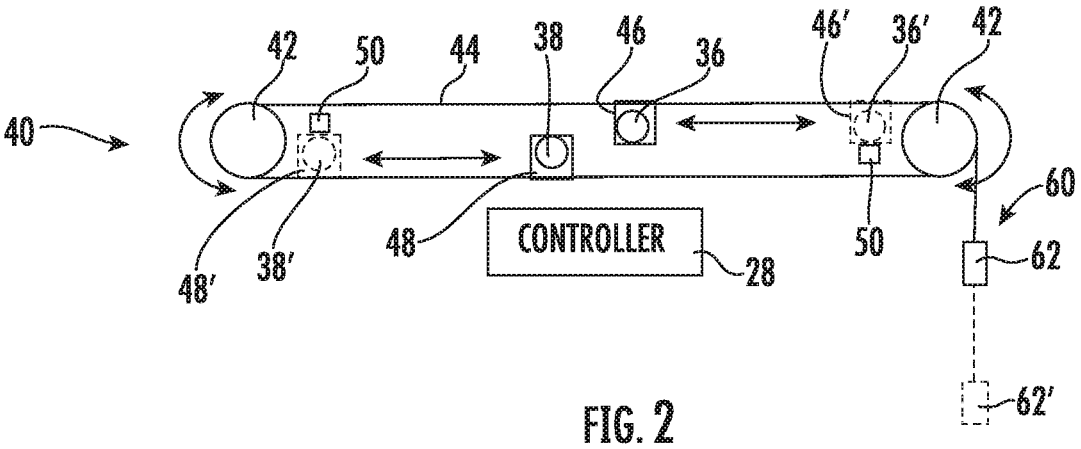
FIG. 2 is a side view schematically illustrating an example actuator configuration for moving sway dampers into selected positions.
Figure 3:
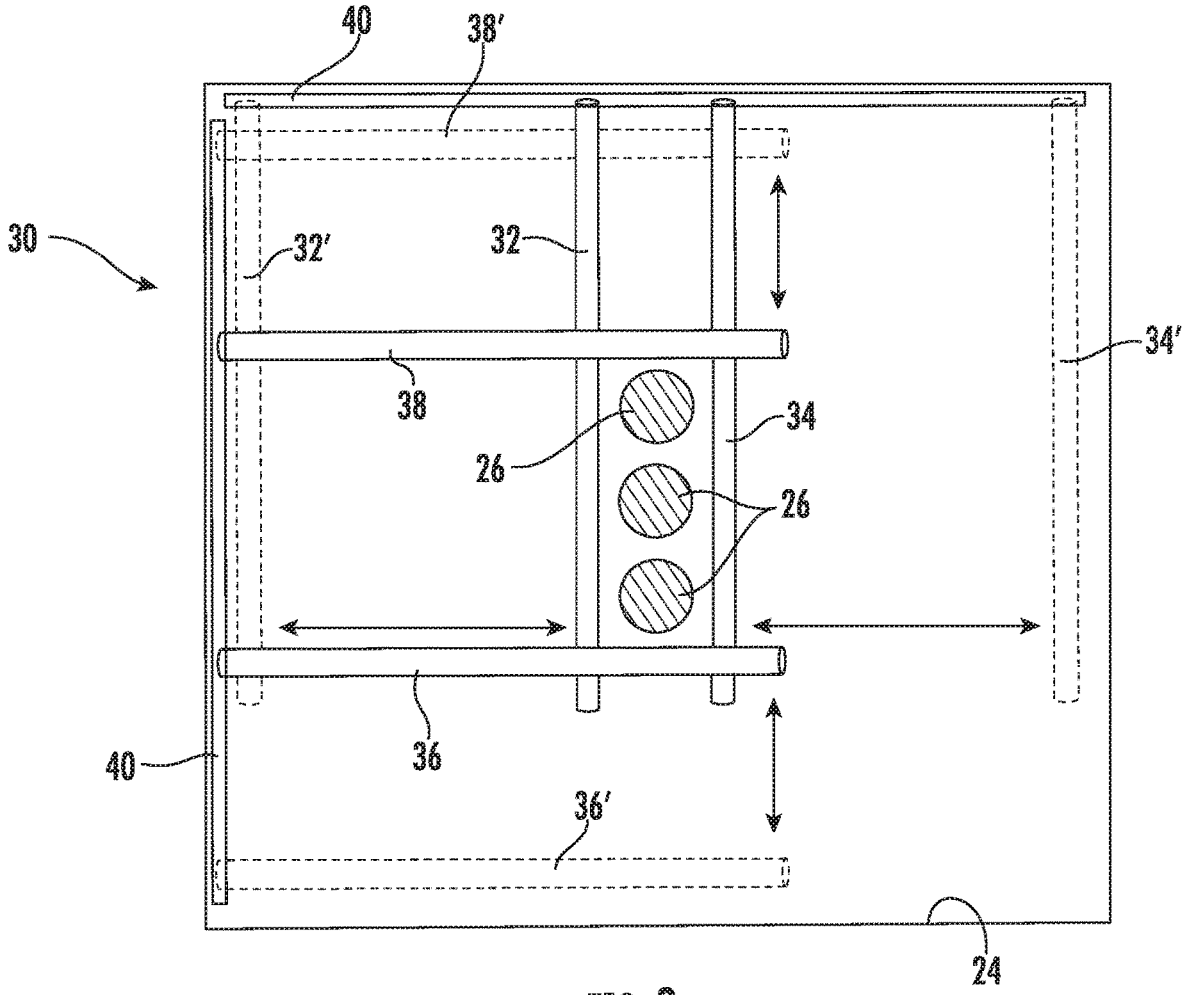
FIG. 3 is a plan view schematically illustrating an example embodiment of sway dampers in damping positions.

As shown in FIGS. 2 and 3, each set of sway dampers 32-38 of the sway damping assembly 30 has an associated actuator device 40 that moves associated the sway dampers 32-38 between the first and second positions. In the illustrated example embodiment, the actuator device 40 includes a plurality of sheaves 42 and a band 44 that at least partially wraps around the sheaves 42. The band 44 forms a loop around the sheaves 42 in this embodiment. The band in some embodiments is a cable or rope. In other embodiments, the band 44 is a belt.

Mounting brackets 46 and 48 are secured to the band 44. The mounting bracket 46 supports the sway damper 36 and the mounting bracket 48 supports the sway damper 38. Another actuator device 40 with its own band and mounting brackets supports the sway dampers 32 and 34 in the same manner.

The controller 28 controls operation of the actuator device 40 to selectively move the sway dampers 36, 38 between the first position and the second, sway-damping position. In some embodiments, the actuators 40 have a dedicated controller while in others the actuator device control is accomplished by a controller that performs other control functions in the elevator system 20. When sway damping is desired, the actuator device 40 moves the sway dampers 36, 38 into the second position as illustrated in FIGS. 2 and 3.

At least one of the sheaves 42 of the actuator device 40 is motorized and rotates in a first direction to move the sway dampers 36, 38 toward the first position and in a second, opposite direction to move the sway dampers 36, 38 toward the second position. In FIG. 2, sheave rotation in a clockwise direction moves the band 44, the mounting brackets 46, 48 and the sway dampers 36, 38 toward the first position. Counter-clockwise sheave rotation moves the band 44, the mounting brackets 46, 48 and the sway dampers 36, 38 in the opposite direction toward the second position.

The example actuator device includes detectors 50 that detect when the sway dampers 36, 38 are in the first position shown in broken lines at 36', 38'. The detectors 50 provide an indication to the controller 28 when the sway dampers 36, 38 are in the first position. The controller 28 uses that indication to control movement of the elevator car. In some embodiments, the controller 28 prevents movement of the elevator car 22 whenever any of the detectors 50 does not indicate that its corresponding sway damper is in the first position similar to how elevator cars are prevented from moving when any of the elevator system doors is not closed. In other embodiments, the controller 28 allows some movement of the elevator car 22 even when one or more of the detectors does not provide an indication that the corresponding sway damper is in the first position.

In the example embodiment shown in FIG. 1, the elevator car 22 includes a shield 52 above and below the elevator car 22. The shields each include two exterior surfaces 54 oriented at an oblique angle relative to a height of the hoistway 24. The exterior surfaces 54 are configured to engage any sway damper that is not in the first position and to urge the sway damper into the first position as the elevator car 22 moves through the corresponding portion of the hoistway 24.

In some embodiments, the controller 28 modifies the motion profile of the elevator car 22 while moving through a portion of the hoistway that includes a sway damper in the way of the elevator car 22. For example, the elevator car 22 may proceed more slowly as it approaches and eventually passes a sway damper outside of the first position so the exterior surface(s) 54 of the appropriate shield 52 will engage and move the sway damper without damaging it or the associated actuator device 40.

The actuator device 40 shown in FIG. 2 includes a biasing mechanism 60 that urges the sway dampers 36, 38 into the first position shown in broken lines at 36', 38'. In this example embodiment, the biasing mechanism 60 includes a counterweight 62 associated with one of the sheaves 42. Gravity urges the counterweight 62 into the position shown at 62' to cause corresponding rotation of the associated sheave 42, which moves the band 44, the mounting brackets 46, 48 and the sway dampers 36, 38 into the first position.

As can be appreciated from FIG. 3, the sway dampers 32-38 are situated near the roping 26 when they are in the second, sway-damping position as shown. The sway dampers in FIG. 3 are rollers that are rotatable about an axis aligned with their length, which is substantially greater than their width. The length is horizontally oriented in the hoistway 24 and the actuator devices 40 move the sway dampers 32-38 in a linear horizontal direction that is perpendicular to their respective width. Such an arrangement allows for the sway dampers 32-38 to be selectively moved out of the way of the elevator car or toward the center of the hoistway 24 where the sway dampers can minimize or reduce sway of the roping 26.

As can be appreciated from FIG. 3, the roping 26 is situated near a center of the hoistway 24. The sway dampers 32 and 34 are situated on opposite sides of the roping 26 to prevent sway in a first direction while the sway dampers 32 and 34 are in the second position. The sway dampers 36 and 38 are situated on opposite sides of the roping 26 to prevent sway in a second direction, which is perpendicular to the first direction, when the sway dampers 36 and 38 are in the second position.

The length of the sway dampers 32-38 may correspond to a width or depth of the hoistway 24 as shown in FIG. 1 or may be only long enough to protrude into the hoistway 24 far enough to reach the roping 26 and provide sway damping as shown in FIG. 3.

As shown in FIG. 1, the elevator car 22 includes a door mover 70 that opens and closes car doors 72. A door coupler 74 facilitates moving hoistway doors at a landing 76 with the car doors 72. The first position of the sway dampers 34 in the illustrated arrangement provides clearance for the door mover 70 and the door coupler 74 so those components will not be damaged as the elevator car 22 moves through the hoistway 24.

Figure 4:
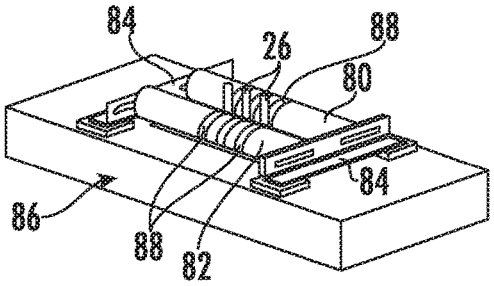
FIG. 4 is a perspective illustration diagrammatically showing a damper configuration useful in an embodiment of this disclosure.

FIG. 4 shows additional sway dampers 80, 82 that are supported on brackets 84 that are configured to be mounted on a structure 86 near one end of the hoistway 24. In some examples, the structure 86 is a floor of a machine room that includes an opening through which the roping 26 passes. The sway dampers 80, 82 include grooves 88 that accommodate the roping 26. In some embodiments, the sway dampers 80, 82 are controlled by actuator devices 40 (as shown in FIG. 2, for example, but not included in FIG. 4) to selectively move the sway dampers 80, 82 into a sway-damping position. In other embodiments, the sway dampers 80, 82 are passive and situated to resiliently engage the roping 26 under certain sway conditions.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator rope sway damping assembly, comprising:

a plurality of sway dampers having a length and a width; and an actuator device that selectively causes movement of the sway dampers in a direction transverse to the length between a first position where the sway dampers are spaced apart by a first distance and a second, sway-damping position where the sway dampers are spaced apart by a second, shorter distance, the actuator device providing an indication when the sway dampers are in the first position, wherein the actuator device includes a plurality of sheaves and a band that wraps at least partially around the sheaves, at least one of the sheaves rotates to cause movement of the band, and the sway dampers are supported for movement with the band between the first and second positions in response to rotation of the at least one of the sheaves.

2. The assembly of claim 1, wherein the sway dampers comprise elongate cylindrical bumpers, and the length is greater than the width.

3. The assembly of claim 2, wherein the sway dampers comprise rollers supported to rotate about an axis along the length.

4. The assembly of claim 1, wherein the actuator device causes linear movement of the sway dampers between the first and second positions.

5. The assembly of claim 1, wherein the band has a length that is oriented perpendicular to the length of the sway dampers.

6. The assembly of claim 1, wherein the actuator device includes a plurality of mounting brackets secured to the band; and the sway dampers are supported on the mounting brackets.

7. The assembly of claim 1, wherein the at least one of sheaves rotates in a first direction to move the sway dampers toward the first position and in a second, opposite direction to move the sway dampers toward the second position.

8. The assembly of claim 7, wherein the actuator device comprises a biasing mechanism that includes a weight associated with at least one of the sheaves, and gravity urges the weight to cause rotation of the at least one of the sheaves in the first direction.

9. The assembly of claim 1, wherein the actuator device includes a biasing mechanism that biases the sway dampers into the first position.

10. The assembly of claim 1, wherein the actuator device includes at least one detector that detects when the sway dampers are in the first position and provides an output indicating that the sway dampers are in the first position.

11. An elevator system comprising:

the assembly of claim 1, an elevator car situated in a hoistway, a plurality of suspension members supporting the elevator car, and a controller that controls movement of the elevator car, the controller using the indication from the actuator device for controlling movement of the elevator car in a portion of the hoistway that includes the sway dampers.

12. The elevator system of claim 11, wherein the controller prevents the elevator car from moving into the portion of the hoistway when the sway dampers are not in the first position.

13. The elevator system of claim 11, wherein the controller adjusts a motion profile of the elevator car for moving through the portion of the hoistway when the sway dampers are in the second position.

14. The elevator system of claim 13, wherein the elevator car includes an external surface oriented at an oblique angle relative to a direction of movement of the elevator car; and the external surface is configured to engage the sway dampers and move the sway dampers toward the first position as the elevator car moves into the portion of the hoistway that includes the sway dampers.

15. The elevator system of claim 11, wherein the plurality of sway dampers includes a plurality of sets of sway dampers, each set of sway dampers is in a different vertical location along the hoistway, and the controller controls the sets of sway dampers to selectively move the sway dampers between the first and second positions based, in part, on a location of the elevator car in the hoistway.

16. The elevator system of claim 11, wherein the length of the sway dampers is transverse to a height of the hoistway;

the sway dampers extend from one side of the hoistway toward a center of the hoistway; and the actuator device moves the sway dampers in a direction parallel to the side of the hoistway when moving the sway dampers between the first and second positions.

17. The elevator system of claim 16, wherein the length of the sway dampers are horizontal, and the actuator device moves the sway dampers linearly and horizontally between the first and second positions.

18. The elevator system of claim 11, wherein the elevator car has a depth, a width and a height; and the first distance between the sway dampers in the first position is greater than the depth and greater than the width.

19. The elevator system of claim 11, wherein the plurality of suspension members are situated near a center of the hoistway;

a first one of the sway dampers and a second one of the sway dampers are situated on opposite sides of the suspension members to prevent sway in a first direction when the first and second sway dampers are in the second position;

a third one of the sway dampers and a fourth one of the sway dampers are situated on opposite sides of the suspension members to prevent sway in a second direction when the third and fourth sway dampers are in the second position; and the second direction is perpendicular to the first direction.

* * * * *